US006995710B2

(12) United States Patent
Sugimoto et al.

(10) Patent No.: US 6,995,710 B2
(45) Date of Patent: Feb. 7, 2006

(54) DIELECTRIC ANTENNA FOR HIGH FREQUENCY WIRELESS COMMUNICATION APPARATUS

(75) Inventors: Noriyasu Sugimoto, Aichi (JP); Takashi Kanamori, Aichi (JP); Daisuke Nakata, Aichi (JP); Susumu Wakamatsu, Gifu (JP); Toshikatsu Takada, Aichi (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 319 days.

(21) Appl. No.: 10/267,048

(22) Filed: Oct. 9, 2002

(65) Prior Publication Data

US 2003/0092420 A1 May 15, 2003

(30) Foreign Application Priority Data

Oct. 9, 2001 (JP) ..... 2001-311916
Mar. 4, 2002 (JP) ..... 2002-056904

(51) Int. Cl.
*H01Q 1/38* (2006.01)

(52) U.S. Cl. ..... 343/700 MS

(58) Field of Classification Search ..... 343/700 MS, 343/895, 873

See application file for complete search history.

(56) References Cited

U.S. PATENT DOCUMENTS

| | | | | |
|---|---|---|---|---|
| 5,581,262 | A | 12/1996 | Kawahata et al. | |
| 5,764,198 | A | 6/1998 | Tsuru et al. | |
| 5,767,811 | A | 6/1998 | Mandai et al. | |
| 5,767,817 | A | 6/1998 | Tsuru et al. | |
| 5,798,737 | A | 8/1998 | Kanaba et al. | |
| 5,892,490 | A | 4/1999 | Asakura et al. | |
| 5,898,413 | A | 4/1999 | Mandai et al. | |
| 5,909,198 | A * | 6/1999 | Mandai et al. | 343/895 |
| 5,973,651 | A | 10/1999 | Suesada et al. | |
| 5,999,146 | A | 12/1999 | Kanba et al. | |
| 6,052,096 | A | 4/2000 | Tsuru et al. | |
| 6,064,351 | A | 5/2000 | Mandai et al. | |
| 6,222,489 | B1 | 4/2001 | Tsuru et al. | |
| 6,271,803 | B1 * | 8/2001 | Watanabe et al. | 343/895 |
| 6,351,241 | B1 | 2/2002 | Wass | |
| 6,442,399 | B1 | 8/2002 | Tsuru et al. | |
| 6,515,626 | B2 * | 2/2003 | Bark et al. | 343/700 MS |
| 6,693,604 | B2 * | 2/2004 | Washiro et al. | 343/895 |
| 6,720,924 | B2 * | 4/2004 | Tomomatsu et al. | 343/700 MS |
| 6,768,460 | B2 * | 7/2004 | Hoashi et al. | 343/700 MS |
| 6,781,557 | B1 * | 8/2004 | Ueoka et al. | 343/873 |

FOREIGN PATENT DOCUMENTS

| | | |
|---|---|---|
| EP | 0762539 A1 | 3/1997 |
| JP | 8-222944 | 8/1996 |
| JP | 8-335822 | 12/1996 |
| JP | 9-139621 | 5/1997 |
| JP | 10-229304 | 8/1998 |
| JP | 10-247806 | 9/1998 |
| JP | 2996190 | 12/1999 |

* cited by examiner

*Primary Examiner*—Hoang V. Nguyen
*Assistant Examiner*—Angela M Lie
(74) *Attorney, Agent, or Firm*—Stites & Harbison PLLC; Ross F. Hunt, Jr.

(57) ABSTRACT

A dielectric antenna is provided for a high frequency wireless communication apparatus. The antenna includes a dielectric substrate and a conductive meander line layer formed on the dielectric substrate. A conductive feed line layer, having a greater line width than the width of the meander line layer, is also formed on the dielectric substrate. A conductive taper layer connects the conductive meander line layer to the conductive feed line layer. An edge of the conductive taper layer slants at an angle from an adjacent edge of the conductive feed line layer in a direction toward the conductive meander line layer.

16 Claims, 10 Drawing Sheets

Fig. 6 (a)
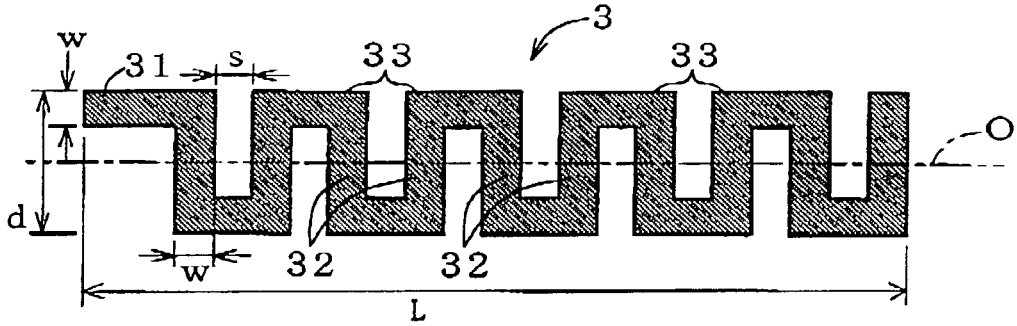
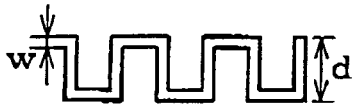
Fig. 6 (b)
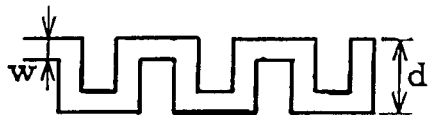
Fig. 6 (c)

PRIOR ART

DIELECTRIC ANTENNA FOR HIGH FREQUENCY WIRELESS COMMUNICATION APPARATUS

BACKGROUND OF THE INVENTION

1. Field of the Invention

This invention relates to an antenna in use for wireless communication, and in particular, to a dielectric antenna having a so-called meander line configuration formed on a dielectric substrate for use in high frequency wireless communication.

2. Related Art

An antenna is an indispensable constituent element in wireless communication but has the disadvantage of consuming or occupying substantial space, relatively speaking. To reduce the size of the antenna, known antenna configurations use a dielectric material and form an antenna line on or within the dielectric material. An example of antennas according to this prior art is described in Japanese Patent Laid-Open No. 13126/1998. To suppress or reduce exothermy (heat evolution) resulting from a power loss from a radiation electrode and to provide an antenna having reduced wavelength fluctuation, the antenna has a construction as shown in FIG. 13. Referring to FIG. 13, the antenna 2100 includes a spiral radiation electrode 2102 formed on an outer surface of a dielectric insulator 2101, a further electrode 2103 electrically connected to the radiation electrode 2102 and having a line width greater than that of the radiation electrode 2102, and a feed terminal 2104 electrically connected to the electrode 2103 for supplying high frequency signals to the radiation electrode 2102 and to the further electrode 2103. According to this construction, the electrode 2103 releases the heat resulting from the power loss of the radiation electrode 2102, and the temperature rise of the radiation electrode 2102 and the insulator 2101 can be suppressed or reduced. As a consequence, fluctuation in the antenna wavelength can be reduced.

When the size of the antenna is reduced to provide miniaturization, i.e., to satisfy a space requirement, the width of the antenna line, i.e., the conductor forming the antenna, becomes quite small. When the antenna line is of a linear shape, the physical length of the antenna must increase. Therefore, to save space, the antenna line is formed in an undulating shape, such as is illustrated, for example, in Japanese Patent No. 3,114,582 and Japanese Patent Laid-Open Nos. 55618/1997 and 139621/1997. In such antennas, the line width of the antenna is likely to be further reduced in order to provide a decrease in antenna length by use of the undulating shape.

Generally speaking, the greater the number of components, the greater the size of the antenna because of the need for impedance matching. Moreover, impedance mismatching with the line on the component packaging substrate is more likely to occur, thereby resulting in deterioration of the radio wave radiation characteristics. In other words, it is more difficult to efficiently transmit the high frequency signals supplied from a feed terminal to the antenna line. The length of the antenna line is generally adjusted to control such impedance mismatching. However, given ever more demanding space requirements, i.e., due to the need for miniaturization, the antenna line length cannot always be arbitrarily changed. Further, while it is known to insert a matching circuit between the line on the component packaging substrate side and the antenna line, the addition of such a matching circuit tends to increase production costs and to consume excessive space, which is, of course, contrary to the need for miniaturization.

There are various factors causing impedance mismatching between the antenna line and the feed terminal portion. For instance, when, due to design limitations, the antenna line width is different from the width of a feed strip line for signal transmission, and particularly when the width of the antenna line is smaller than that of the feed strip due to miniaturization of the antenna, a problem with impedance mismatching is most likely to occur.

SUMMARY OF THE INVENTION

It is an object of the invention to provide a dielectric antenna which is capable of eliminating impedance mismatching resulting from miniaturization of the antenna without the addition of a special matching circuit, and which is thus capable of efficiently and economically preventing a drop in the efficiency of radiation of radio waves, resulting from impedance mismatches.

The above object of the present invention is achieved by providing, in accordance with a first aspect thereof, a dielectric antenna for a high frequency wireless communication apparatus, comprising: a dielectric substrate; a conductive meander line layer formed on the dielectric substrate; a conductive feed line layer formed on the dielectric substrate and having a greater line width than the width of the meander line layer; and a conductive taper layer connecting the conductive meander line layer to the conductive feed line layer, said conductive layer of the conductive taper layer having a slanting edge forming an angle $\gamma$ with an adjacent edge of the conductive feed line layer in a direction toward the conductive meander line layer, the angle $\gamma$ comprising an angle of 110°–175°.

In this embodiment, formation of the conductive taper layer effectively achieves impedance matching without affecting the space savings provided by miniaturization of the antenna, and provides excellent radio wave radiation characteristics.

In accordance with another aspect of the invention, the dielectric antenna comprises first and second conductor portions formed on a dielectric substrate of the antenna and electrically connected to each other through a connection conductor portion having a tapered shape that expands in width at a predetermined taper angle from the first conductor portion side towards the second conductor portion side. When the taper angle of this connection conductor portion is 5° to 70° (preferably 8° to 68° and, more preferably, 10° to 60°), the antenna suppresses impedance mismatching and efficiently radiates the high frequency signals.

According to yet another aspect of the invention, the above object of the invention is achieved by providing a dielectric antenna for high frequency wireless communication apparatus, the antenna comprising: a dielectric substrate; a conductive meander line layer formed on the dielectric substrate; a conductive feed line layer formed on the dielectric substrate and having a greater line width than the width of the meander line layer; and an extended feed line extending from a feed strip formed on a surface of a further dielectric substrate having a dielectric constant lower than the dielectric constant of the dielectric substrate and having a ground plane on a further, opposed surface of the further dielectric substrate, the extended feed line being extended by a predetermined length from a position at which the ground electrode terminates and is separated by the further dielectric substrate; the predetermined length being about 2.5–7.5 mm.

In this aspect of the invention, the impedance mismatch caused by the difference in specific dielectric constant between the dielectric substrate on which the feed strip is formed and the dielectric substrate on which the antenna comprising the meander line layer is formed is effectively eliminated by the provision of the extended feed line.

In accordance with still another aspect of the invention, improved matching is attained by combining important features of the embodiments of the invention described above.

According to yet another aspect of the invention, various dimensional factors and relationships relating to the meander antenna line are provided which improve the performance of the dielectric antenna.

Further features and advantages of the present invention will be set forth in, or apparent from, the detailed description of preferred embodiments thereof which follows.

BRIEF DESCRIPTION OF THE DRAWINGS

FIGS. 6(*a*), 6(*b*) and 6(*c*) show, respectively, three different configurations of a meander line portion of the antenna, according to a further aspect of the invention;

FIG. 12(*b*) is a plan view showing the dimensions and configuration of the dielectric antenna stacked in the dielectric substrates shown in FIG. 12(*a*)

DETAILED DESCRIPTION OF THE PREFERRED EMBODIMENTS

An embodiment according to a first aspect of the invention will be explained with reference to the drawings, and in particular, in relation to FIG. 1.

Figure 1:
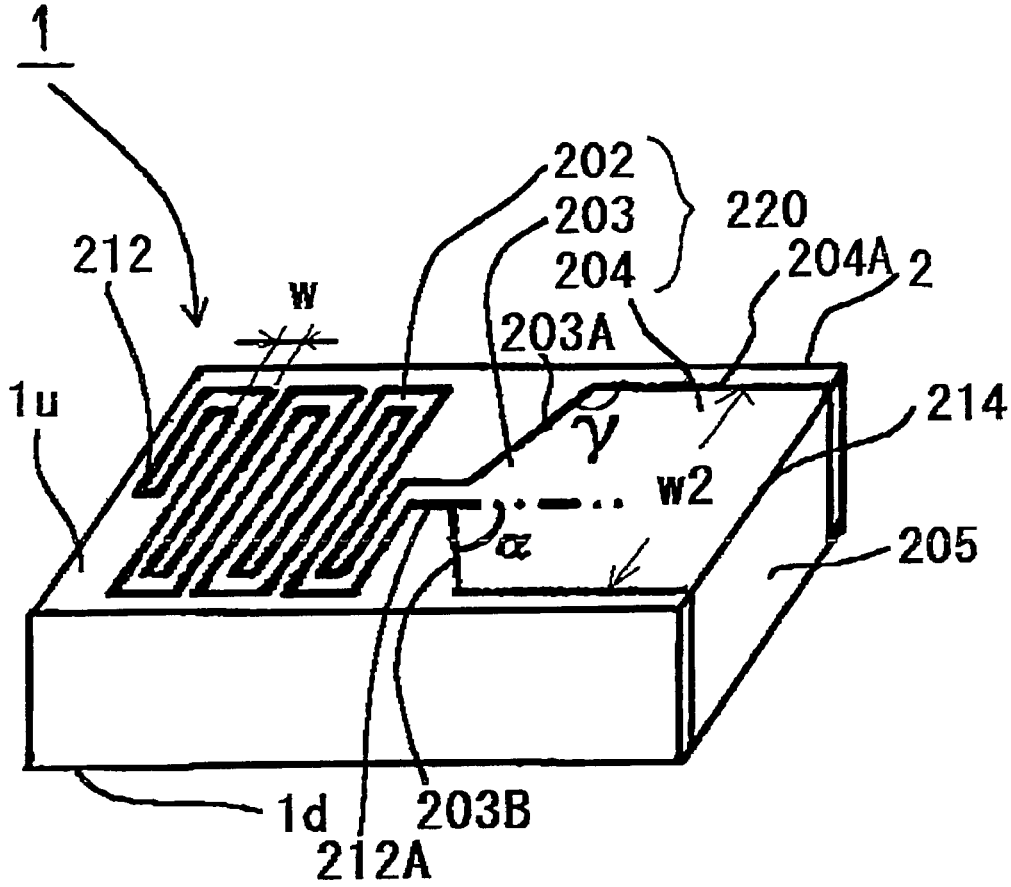
FIG. 1 is a perspective view of a dielectric antenna according to a first embodiment of the invention.

Referring to FIG. 1, a dielectric antenna 1 includes a dielectric substrate 2 typically made of alumina ceramic and having a rectangular solid shape, and a conductor portion 220 typically formed of Ag baked on one of the main surfaces 1*u* of the dielectric substrate 2. The conductive portion 220 comprises a conductive meander line layer or element 202, and a conductive feed line layer or element 204 and a conductive taper layer or element 203. The taper layer 203 connects one end of the meander line layer 202 to the feed line layer 204, and has an edge 203A thereof which is slanted with respect to, i.e., is inclined an angle to, an adjoining edge 204A of the feed line layer 204 in a direction toward the meander line layer 202. An angle γ of 110°–175°, and more preferably 120°–170°, is formed between the edges. The other end 212 of the meander line layer 202 is an electrically free end. The other end 214 of the feed line layer 204 is connected to a feed terminal 205 formed on an adjacent end the dielectric substrate 2.

The feed layer 204 and the feed terminal 205 have a common line width (Wz) that is greater than the width (w) of the meander line layer 202. As illustrated, the line width of the taper layer 203 increases from the meander line layer 202 toward the feed line layer 204. In other words, if the meander line edge 212A extends parallel to the longitudinal axis of the meander line (or, stated differently, extends parallel to the longitudinal axis of the dielectric substrate), as shown in FIG. 1, the slanting edge 203B of the taper layer extending from the meander edge 212A should form a slanting angle α, with α being an angle of 5°–70°, or preferably 8°–68°, or more preferably 10°–70°.

The antenna 1, having the construction described above, advantageously provides suppression of impedance mismatching occurring at the junction between the meander line layer portion 202 and the feed line layer portion 203, and also enables efficient transmission of the radio frequency signals from the feed terminal 205. Because impedance matching between an antenna portion (i.e., the meander line pattern portion) and a conductor portion (i.e., the feed portion) can be established through such simple construction, the design of the antenna conductive line pattern is simplified. Further, because the feed terminal 205 at the end surface of the dielectric substrate 2 has the same line width as that of the feed line layer 204, impedance mismatches at the junction between the feed line layer 204 and the feed terminal 205 can also be eliminated, and radio frequency signals can be efficiently transmitted or received through the feed terminal 205.

Figure 2:
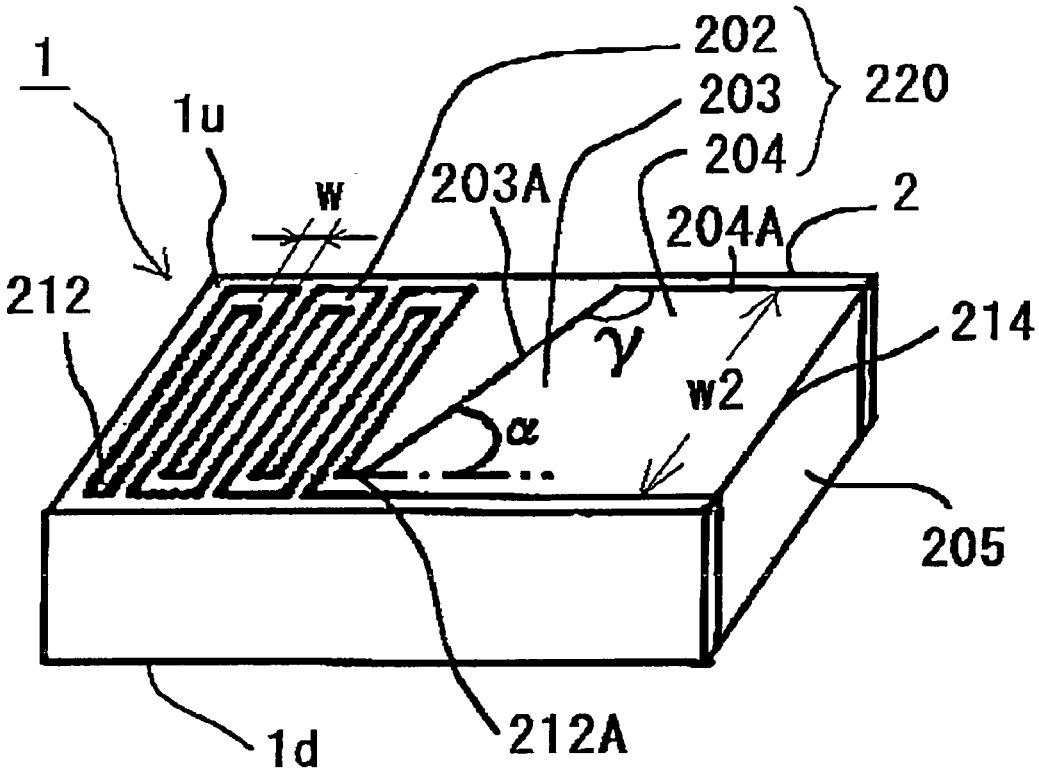
FIG. 2 is a perspective view showing another implementation of a dielectric antenna according to the first embodiment of the present invention.

Dielectric antennas corresponding to those described above have been prepared for experimental use as follows, using a configuration as shown in FIG. 2. In an exemplary implementation, predetermined amounts of alumina, titanium oxide and tin oxide used as the raw materials for the dielectric substrate 2 are weighed and mixed, and the mixed powder is pressure-molded. The resulting molding is then fired. The molding so fired is cut into a dielectric substrate 2 which, as implemented here, is of a rectangular solid shape having a width of 2.5 mm, a length of 11 mm and a height of 0.8 mm. An electrically conductive paste consisting of Ag as a main component is printed on a main surface 1*u* of the dielectric substrate 2 through screen-printing and is baked to form a conductor portion 220. A feed terminal 205 is formed in the same way. The conductor portion 220, after baking, includes a meander line layer or portion 202 having a line width (w) of 0.3 mm, a line spacing (s) of 0.3 mm and a fold-back width (d) of 1.5 mm, a feed line layer or portion 204 having a line width (w2) of 1.5 mm, and a taper layer or portion 203 having, respectively, a taper angle α of 5°, 16°, 31°, 50° and 70°. The parameters s and d are discussed in more detail below in connection with FIG. 6(*a*). The number of "loops" of the meandering or undulating configuration is approximately three, as shown.

In this way, there are produced five kinds of antennas for a 5.2 GHz band, each having a different taper angle α and each being of a similar configuration to that of FIG. 2.

For comparison purposes, an antenna was produced having an antenna line pattern including the first conductor portion 202 having the same line width (w), the same line spacing (s) and the same fold-back width (d) as those of the embodiment described above and a feed line layer 204 having the same line width (w2) as that of these embodiment but having angles α and γ of 90° (in other words, with taper layer or portion 203 eliminated).

In the comparison testing, each of the antennas is bonded to an evaluation substrate, and its reflection coefficient at 5.2 GHz is measured by use of a network analyzer. Table 1 below is a tabulation of the result.

TABLE 1

| | Taper angle α(°) | reflection coefficient (dB) |
|---|---|---|
| Example 1 | 5 | −35.140 |
| Example 2 | 16 | −37.840 |
| Example 3 | 31 | −57.550 |
| Example 4 | 49 | −36.325 |
| Example 5 | 70 | −34.985 |
| Com. Example | nil | −32.854 |

It will be understood from Table 2 that all of the examples having a tapered shape, i.e., including the taper layer or portion 203, identified as Examples 1–5, show an improvement in the reflection coefficient and the transmission efficiency as compared with the example not having the taper and identified as the Comparative Example. It was also confirmed that the difference in the taper shape between FIGS. 1 and 2 does not result in a significant variation in the antenna performance, as measured by the reflection coefficient and the transmission efficiency. However, the configuration of FIG. 2 may be preferred from a practical standpoint only because the configuration of FIG. 2 is simpler than that of FIG. 1.

Figure 3:
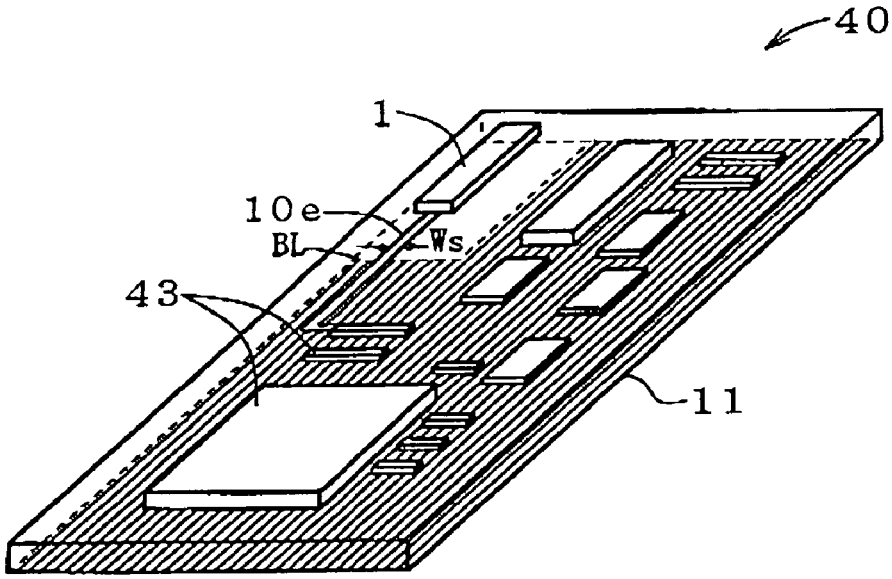
FIG. 3 is a perspective view showing an exemplary circuit module for high frequency wireless communication, including a dielectric antenna disposed on a dielectric substrate of the circuit module.

Referring to FIG. 3, there is shown a dielectric antenna 1 disposed on another dielectric substrate forming an antenna module 40, according to another embodiment based on a further aspect of the invention. In FIG. 3, various electronic components including a dielectric antenna 1 and antenna circuit components 43 are disposed on the dielectric substrate of the antenna module 40.

Figure 4:
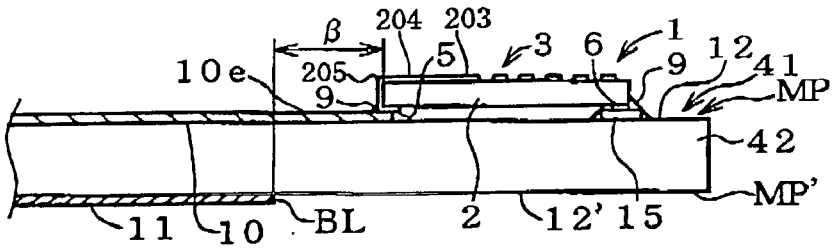
FIG. 4 is a cross sectional view of a dielectric antenna disposed on a dielectric substrate, showing a feed line according to a further aspect of the invention.

Referring to FIG. 4, on a second dielectric substrate 42, a feed strip 10 is formed, such that the associated grounding back conductor layer 11 covers the back of the dielectric substrate 42. A region 12 on a main surface, denoted MP, corresponding to the region 12' where the grounding back conductor 11 is not formed, is provided as a packaging area or mounting site for the dielectric substrate 2 of the dielectric antenna 1.

A longitudinally extending feed line 10*e* extends from a feed strip 10 to the feed terminal 205 by a predetermined length, denoted β, from a position corresponding to a boundary line (BL) located between the region of the back conductor layer 11 and the region where the back conductor layer 11 is not formed. A surface packaging pad 5 is formed on the back of the dielectric antenna 1, for securely connecting the feed terminal 205 to the end of the extended feed line 10*e* through a solder bonding portion 9. An auxiliary pad 6 is formed on the back of the dielectric substrate 2 so as to bonded to a support pad 15 formed on the substrate 42 through the solder bonding portion 9.

The extended feed line 10*e* is important in reducing or preventing impedance mismatching between the dielectric antenna 1 and the feed strip 10 through which electrical signals are transmitted and received. As described above, conventionally, a matching component is provided between the dielectric antenna and the feed strip. Such a matching component is unnecessary if the feed line 10 is incorporated in the dielectric substrate 42 of the circuit module 41, where substrate 42 has a lower specific dielectric constant than that of the dielectric substrate 2 of the dielectric antenna 1.

Figure 7:
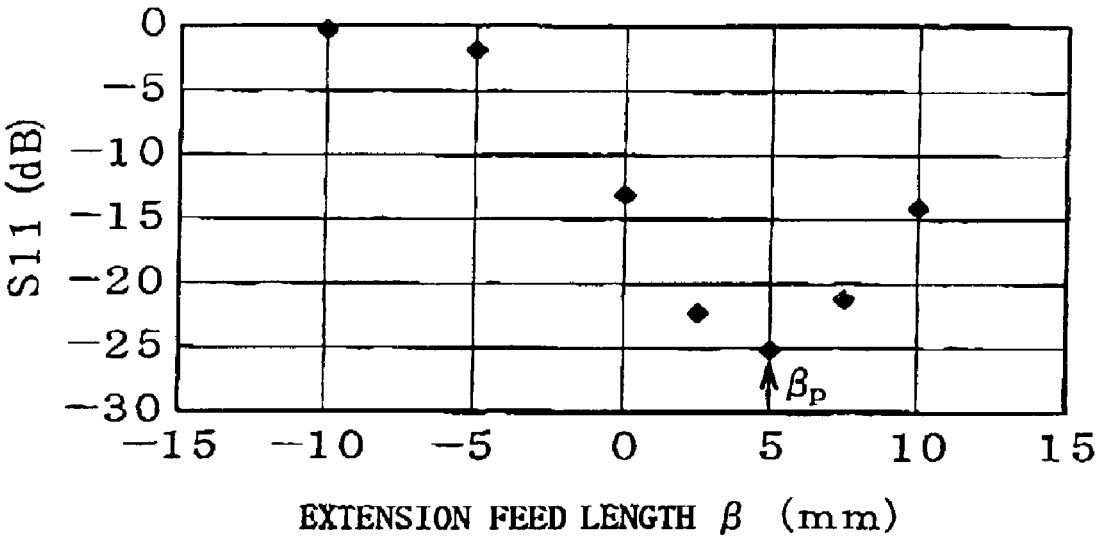
FIG. 7 is a graph showing experimental results obtained by measuring the relation between the length of an extended feed line, denoted β, and the corresponding reflection coefficient S11.

As can be understood from the graph of FIG. 7, it has been found that an appropriate length β for the extended feed line 10*e* is about 2.5 mm–7.5 mm.

Figure 11:
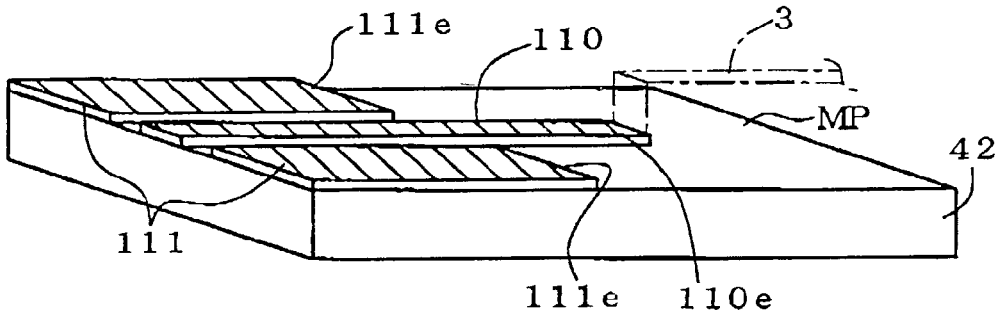
FIG. 11 is a perspective view of a co-planer waveguide constituted as a feed strip, according to a further aspect of the invention.

Further, as shown in FIG. 11, two grounding back conductors 111*e* can be formed on the same main surface MP on which a feed strip 110 and an extended feed line 110*e* are formed, with the grounding back conductors 111*e* sandwiching, i.e., being disposed on opposite sides, the feed strip 110.

Figure 5:
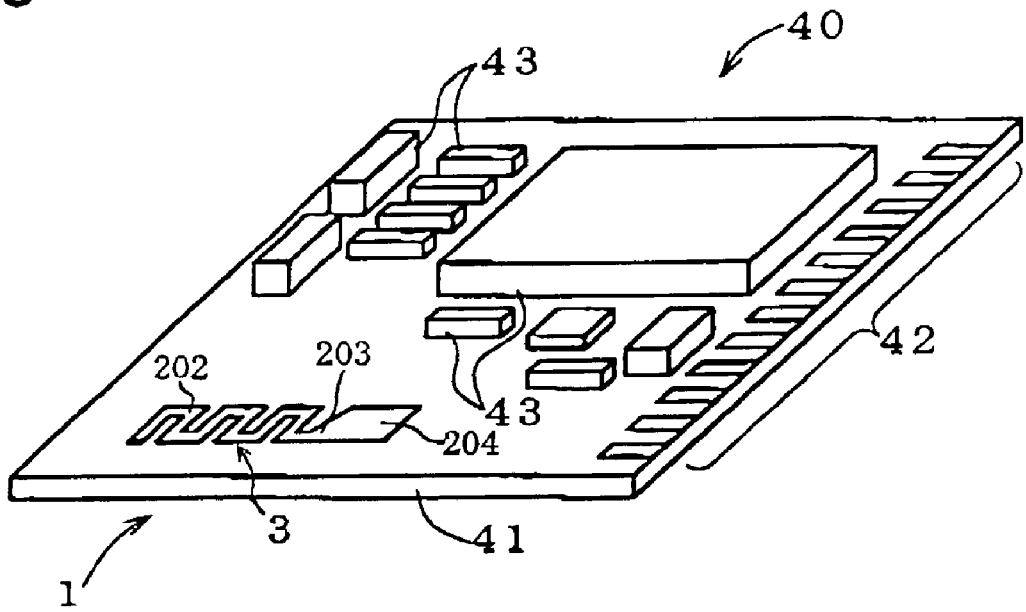
FIG. 5 is a perspective view of a dielectric antenna according to a further embodiment of the invention, wherein the antenna is directly formed on a dielectric substrate incorporating a circuit module for high frequency wireless communication.

Referring to FIG. 5, in accordance with another aspect of the invention, a single dielectric substrate 42 may be used, as shown in FIG. 5, as a common substrate for multiple components, i.e., as the dielectric substrate for an antenna 3 having a conductive meander line layer 202, a conductive taper layer 203 and a conductive feed layer 204, and also as the substrate on which various electronic components for the associated antenna circuit module are disposed.

Referring to FIGS. 6(*a*) to 6(*c*), in accordance with another aspect of the invention, the conductive meander line layer should be carefully designed and constructed in order to attain the highest antenna performance, especially with respect to the parameters of line width (w), line spacing (s) and fold-back width (d) as shown in FIGS. 6(*a*) to 6(*c*).

Figure 8:
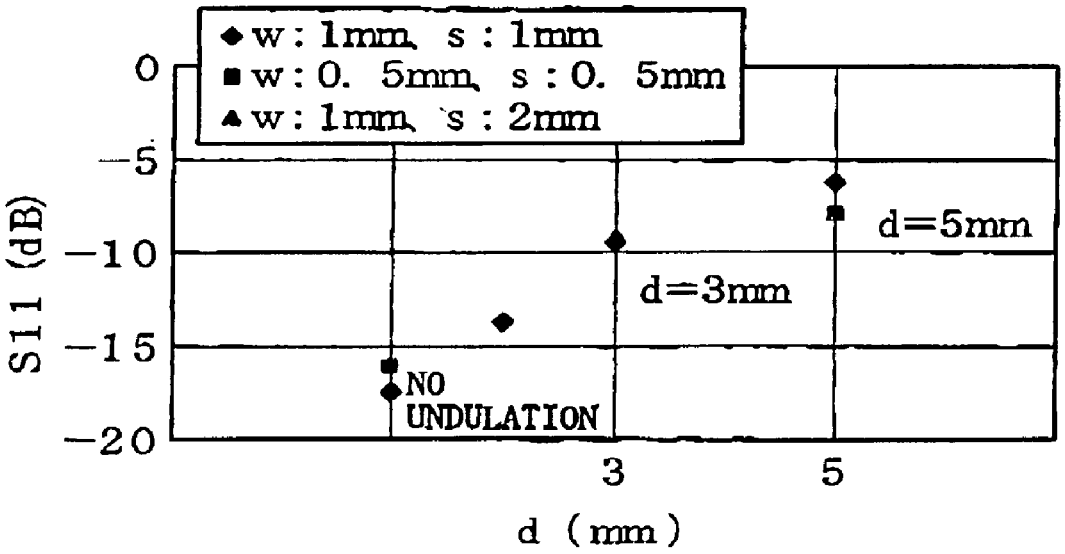
FIG. 8 is a graph showing experimental results obtained by measuring the relation between the fold-back width (d) of a meander line pattern and the reflection coefficient S11.

An explanation will be provided based on the results of experiments carried out to examine the influences of the meandering or fold-back width (d). First, in these experiments, an alumina substrate (thickness: 1 mm) is used as the dielectric antenna substrate 2. Dielectric antennas having a total line length of 30 mm are produced wherein the fold-back width (d), the line width (w) and the facing edge spacing (s) are changed in various combinations. Each of these antennas is connected to a network analyzer (HP-8510C, produced by Hewlett Packard Co.) and the reflection coefficient S11 of the various antennas at 2.4 GHz is measured. FIG. 8 shows the result. Table 2 below is a tabulation of the individual measurement point data of FIG. 8.

TABLE 2

| w/s | 1/1 | 0.5/1 | 1/2 |
|---|---|---|---|
| Line (d = 1) | −17.38 | −16.02 | — |
| Line (d = 2) | −13.44 | — | — |
| Line (d = 3) | −9.32 | — | −8.98 |
| Line (d = 5) | −6.10 | −4.2 | — |

It will be understood from these experimental results, as tabulated in Table 2, that the smaller the line width (w), the smaller the reflection coefficient (S11), regardless of the line width (w) and the opposing edge spacing (s), and the radiation efficiency of the radio wave is improved. It will be also understood that when the fold-back width (d) is smaller than 3 mm, an antenna gain value of −8 dB or below, i.e., that of a sufficient value, can be attained.

When the specific dielectric constant of the dielectric material forming the antenna substrate 2 is increased, the antenna length can be decreased. However, this results in a decrease in the radiation efficiency of the radio wave and/or a more narrow bandwidth due to a no-load increase in some cases. In view of this, the dielectric material forming the antenna substrate 2 preferably has specific dielectric constant of not greater than 13 at 2.4 GHz. Alumina ceramics having an alumina content of at least 98%, mullite ceramics or glass ceramics can be appropriately used in the substrate of the invention as materials having a small dielectric loss in a high frequency range. Among the glass ceramics, a ceramics system prepared by adding 40 to 60 parts by weight of an inorganic filler, such as alumina, to borosilicate glass or lead borosilicate glass is preferably used because such a composition has a good co-firing property with a metal line or element formed thereon or therein. Further, inorganic/organic composite materials, such as glass epoxy materials, can be used in place of the ceramic dielectric materials.

The result of experiments conducted to examine the influence of the use of specific dielectric constants will next be explained. In these experiments, the following materials are prepared as the material of the antenna substrate 2 of the dielectric antenna 1 of the type shown in FIG. 1 (all substrates having a thickness of 1 mm).

titania ceramic:
(specific dielectric constant at 2.4 GHz: 21)
alumina ceramic:
(specific dielectric constant at 2.4 GHz: 13)
glass ceramics:
(specific dielectric constant at 2.4 GHz: 8)
glass epoxy:
(specific dielectric constant at 2.4 GHz: 4)

Figure 9:
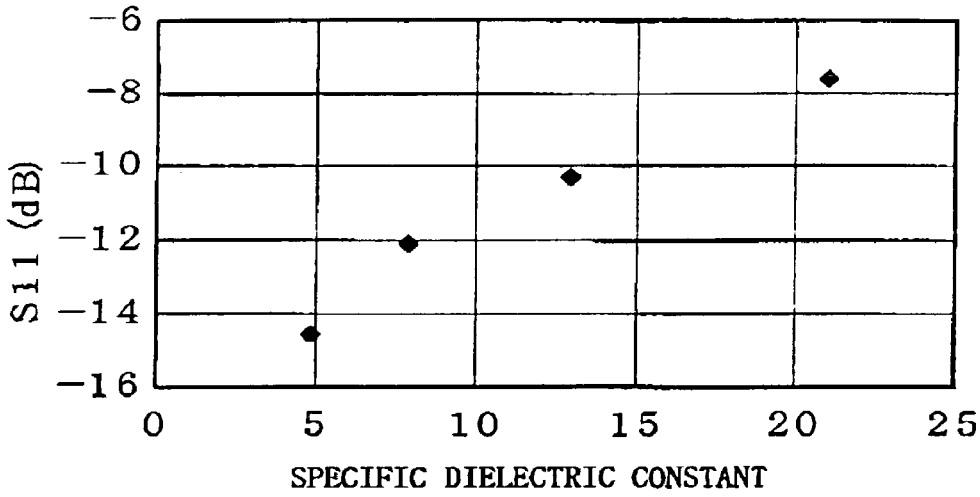
FIG. 9 is a graph showing the relation between the specific dielectric constant of a dielectric substrate incorporating an antenna and the reflection coefficient S11.

Various dielectric antennas were produced by using the antenna substrates 2 described above and, referring to FIG. 6(*a*), setting the fold-back width (d) to 2 mm and the facing edge spacing (s) of the orthogonal line elements 32 to be equal to the line width (w), and so optimizing the entire line length as to attain a resonance frequency of 2.4 GHz. Each of these antennas is connected to the network analyzer as described above, and a reflection coefficient (S11) at 2.4 GHz is measured. FIG. 9 shows the results. It will be understood from the experimental results shown in FIG. 9 that the smaller the specific dielectric constant of the antenna substrate 2, the smaller the reflection coefficient (S11), and thus the greater the improvement in radio wave radiation efficiency. When the specific dielectric constant is set to 13 or below, an acceptable antenna gain of −8 dB can be achieved.

Referring again to FIGS. 3 and 4, it is noted that the optimum length (βp) of the extension feed length (β) of the extended feed line 10*e* changes with the line width (Ws) of the feed strip 10 and with the line width (w) of the antenna line pattern 3. To determine the optimum value of βp, a known method can be used that provides simulation on the basis of a theoretical computation. However, when each line width Ws or w is determined, substrates are produced on which the extension feed length β of the extended feed line 10*e* is varied or changed. Each substrate is then connected to the antenna and the reflection coefficient S11 at the targeted frequency is measured, by use of the above-mentioned, known network analyzer, so that the extension feed length β that minimizes the value of S11 can be determined, i.e., the optimum length (βp) can be determined. It has been found that when the line width (Ws) of the feed strip 10 is 1.0 to 2.0 mm and the line width (w) of the antenna line pattern 3 is within the range of 0.5 to 0.3 mm, as exemplary numerical values, the extension feed length β of the extended feed line 10*e* is optimally adjusted to a value in the range of 2.4 to 7.5 mm.

A concrete example will now be considered. A fired alumina body (width: 3 mm, length: 15 mm, thickness: 1 mm) is used as the dielectric material forming the antenna substrate 2 of the dielectric antenna 1 shown in FIG. 1. Referring to FIG. 6(*a*), an antenna line pattern having a fold-back width (d) of 2.4 mm, a line width (w) of 0.3 mm and a facing edge spacing (s) of 0.3 mm is formed through screen printing, and secondary baking, of an Ag paste. On the other hand, a commercially available glass epoxy substrate having a length of 50 mm, a width of 25 mm and a thickness of 1 mm is prepared as the packaging substrate 42 as exemplified in FIGS. 3 and 4. A grounding back conductor layer 11 (thickness: 35 μm) made of Cu is formed to have a width of 25 mm and a length of 20 mm on one of the reverse main surfaces of the substrate 42, and a feed strip 10 (width: 1.4 mm, thickness: 35 μm) is formed on the other main surface with various extension lengths β of the extended feed line 10*e*. When the characteristic impedance Zo of the feed strip 10 at 2.4 GHz is measured by use of the network analyzer described above with the exception of the extended feed line 10*e*, thus impedance is found to be about 50 Ω.

In the next step, the dielectric antenna 1 is surface-packaged, i.e., mounted, using a solder, to the feed strip 10 on the packaging substrate in the form shown in FIG. 4, and the reflection coefficient S11 at 2.4 GHz is measured by using the network analyzer referred to above. FIG. 7 shows the S11 value so measured as plotted with respect to the extension feed length β of the extended feed line 10*e*. It will be understood from FIG. 7 that S11 is obviously smaller than is the case when no extended feed line 10*e* is formed (β=0) up to a value for β of 10 mm, and thus the radiation characteristics of the radio wave are improved by the provision of an extended feed line of a suitable length. It will also be understood that S11 reaches minimum at β=5 mm and this β value corresponds to the optimum length βp described above. For comparison purposes, S11 is also measured when the feed strip 10 is retracted further into the grounding back conductor layer 11 beyond the boundary line BL (as indicated by the negative values in FIG. 7). It is found in this case that S11 approaches 0, corresponding to complete reflection, so that there is very little radiation of the radio wave, as shown in FIG. 7.

Referring again to FIG. 6(*a*), as indicated above, the antenna line pattern 3 includes a plurality of orthogonal line elements 32 which, as illustrated, extend in a direction so as to cross or intercept the longitudinal axis or extension line ○ of the antenna 3 and are arranged in side by side relation in the longitudinal direction of the antenna. As is also shown in FIG. 6(*a*), the ends of adjacent orthogonal lines element 32 are connected to one another and form, as a whole, a continuous line portion having a meandering or undulating shape.

Because the antenna line pattern 3 is of an undulating shape, the overall antenna length, L, can effectively be decreased. As can be clearly seen in the drawings, it is geometrically impossible to make fold-back width (d) smaller than line width (w). As shown in FIG. 6(*b*), it is therefore possible to provide an undulating shape having a smaller width when the line width (w) is made smaller. Even when the fold-back width (d) is small, a significant effect on decreasing the overall antenna length, L, can be achieved. When the d/w value is set to three or more as the basic condition in providing a predetermined decrease in the antenna length, it is preferred to set the absolute value of the fold-back width (d) to 3 mm or below, irrespective of the line width (w). It is thus possible to effectively combat or suppress deterioration of the radio wave radiation characteristics of the dielectric antenna and to provide a dielectric antenna having a small size, yet high performance, even though an undulating or meander pattern is employed.

Referring again to FIG. 4, and considering this embodiment in somewhat more detail, the surface packaging pad 5 formed on the back of the dielectric antenna 1 is connected to the end of the extended feed line 10*e* through the solder bonding portion 9, as described above. The auxiliary pad 6 is connected to a support pad 15 on the substrate side through the solder bonding portion 9.

As shown in FIG. 4, the antenna line pattern 3 is arranged as a whole on the main surface MP of the antenna substrate 2. When the antenna substrate 2 is constituted by a ceramic dielectric material, a metal having a high melting point such as platinum is used to form the antenna line pattern 3 and is baked simultaneously with the ceramic dielectric material to form the antenna line pattern 3. Because, in this case, the line metal material of the antenna line pattern 3 must be an expensive high-melting metal, the cost of production thereof is likely to increase.

In contrast to the situation described above, when a manufacturing method is employed which fires the antenna substrate 2 and then forms the antenna line pattern 3 through a secondary metallizing treatment of the antenna line pattern 3 on the main surface MP of the antenna substrate 2, a metal having a lower melting point can be economically used as the line metal material. More specifically, a pattern can be printed by use of a metal paste having a relatively low melting point, such as an Ag type paste. The paste is applied to the antenna substrate 2 after baking, and is baked secondarily at a temperature which is lower than the firing temperature of the dielectric material and at which sufficient baking of the metal paste occurs. A chemical plating method or a physical vacuum deposition method can also be used to form the line pattern. Concrete examples include low resistance materials selected from the group consisting of an Ag type (Ag single substance, Ag-metal oxides (oxides of Mn, V, Bi, Al, Si and Cu), Ag-glass addition, Ag—Pd, Ag—Pt, Ag—Rh, etc), and a Cu type (Cu single substance, Cu-metal oxides, Cu—Pd, Cu—Pt, Cu—Rh, etc). It is noted that it is also possible to cover the antenna line pattern 3 formed on the main surface MP of the antenna substrate 2 with a protective dielectric layer (typically 5 to 50 $\mu$m-thick) formed of a polymer or a low temperature baking type ceramic material such as a glass ceramic.

As described above, in the antenna line pattern 3 shown in FIG. 6(*a*), each orthogonal line element 32 is formed in a direction orthogonal to the antenna longitudinal extension direction, i.e., perpendicular to the longitudinal axis of the antenna. Each interconnection line element 33 that interconnects the ends of adjacent orthogonal line elements 32 is formed in the antenna longitudinal direction, i.e., extends parallel to the longitudinal axis of the antenna. The minimum possible value of the length of each orthogonal line element 32 in the antenna longitudinal direction of the antenna is the line width (w). Therefore, a major advantage is that the antenna length can be decreased. However, the form or configuration of the antenna line pattern of the invention is not limited to the specific form described above. It is possible, for example to alternately interconnect orthogonal line elements 32, which are inclined, by an interconnection line element 33 extending parallel to the longitudinal axis of the antenna, or to employ an antenna line pattern in which the orthogonal line elements 32 are joined by smooth interconnections so as to form of a sinusoidal curve. Such antenna line patterns are inferior to the pattern shown in FIGS. 6(*a*)–6(*c*) with respect to decreasing the antenna length, but have the advantage of reducing radio wave radiation loss because these patterns do not include the acutely bent portions shown in FIGS. 6(*a*)–6(*c*).

Figure 10:
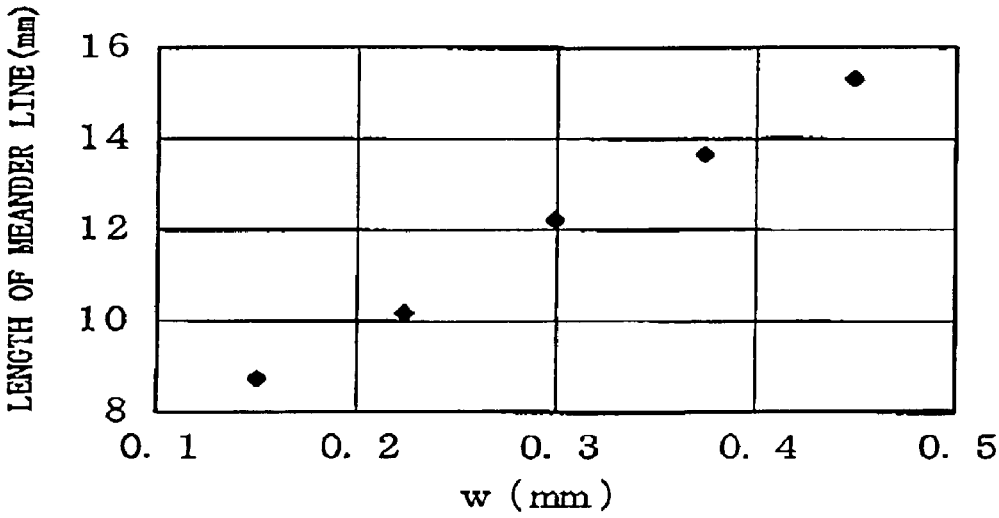
FIG. 10 is a graph showing a relation between the width (w) of a meander line formed on a dielectric substrate and the length of the meander line.

Considering the importance of reducing the antenna length in more detail, FIG. 10 shows the relation between line width (w) and antenna length (L) of a dielectric antenna in which a dielectric material forming the antenna substrate 2 is an alumina baked body (thickness: 1 mm) and the resonance frequency is set to 2.4 GHz. In this case, the undulating or fold-back width (d) is 2 mm and the spacing (s) between facing edges of orthogonal line elements 32 (defined as the distance between facing edges) is set to be equal to the line width (w). It will be understood from FIG. 10 that the smaller the line width (w) of the antenna line pattern 3, the more pronounced the effect on decreasing the antenna length.

When a typical existing mono-pole antenna is formed on a printed board for component packaging, the antenna length necessary for attaining a resonance frequency of 2.4 GHz can be as large as 27 mm. It will be understood from FIG. 10 that when the undulating line pattern described above is used, the antenna length can be reduced to about a half (13.5 mm) of that of the mono-pole antenna by using a line width of 0.3 mm. When the line width (w) is less than 0.05 mm, however, the increase of the inductive component of the antenna pattern increases the characteristic impedance of the antenna. The resultant impedance mismatch with a communication circuit to which the antenna is to be connected makes a decrease in radio wave radiation efficiency likely. Therefore, the line width w is preferably set to at least 0.05 mm.

Figure 12:
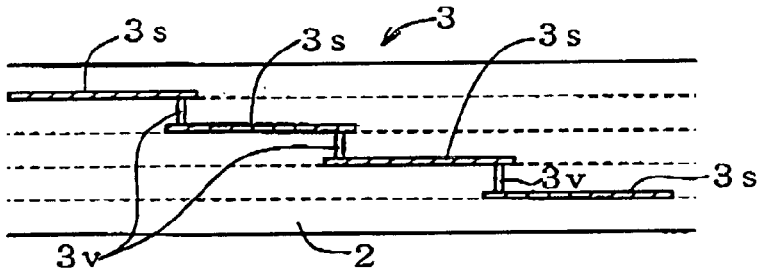
FIG. 12(*a*) is a cross sectional view of a dielectric antenna formed by laminated dielectric substrates, according to another embodiment of the invention.
Figure 12:
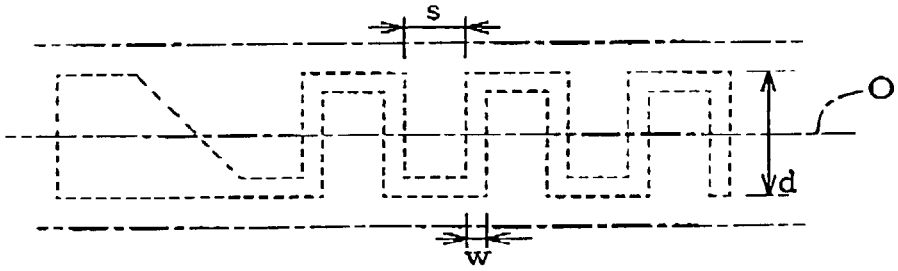
Figure 13:
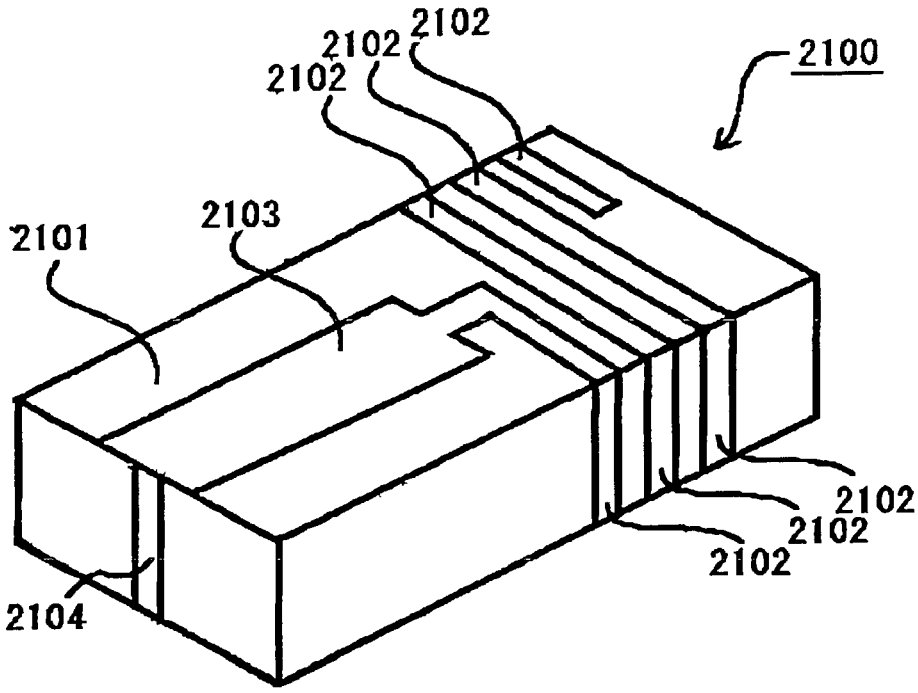
FIG. 13, which was described above, is a perspective view of a dielectric antenna according to the prior art.

Referring to FIG. 12(*a*), the dielectric antenna according to the invention can also be of construction in which the antenna line pattern 3 is divided into stacked layer segments, indicated at 3*s*, with each segment 3*s* being arranged in a different layer of the antenna substrate 2 constituting a stacked body. Each stacked layer segment 3*s* is connected to adjacent segments through an electrically conductive intermediary member indicated at 3*v*. In this construction, the meander antenna line can be embedded inside the stacked structure, as shown in dashed lines in FIG. 12(*b*). Similar dimensional relations to those previously mentioned above with respect to the parameters (w), (s) and (d) can also be applicable to this construction. With this construction, antenna directivity can be achieved without exclusively relying on the main surface of the dielectric substrate.

The opposing edge spacing (s) between the adjacent orthogonal line elements 32 in FIG. 6(*a*) is preferably at least 0.1 mm in order to provide good radiation characteristics. To obtain a pronounced decrease in the antenna length, on the other hand, the spacing (s) between facing edges preferably remains within a range not greater than twice the line width (w). Referring again to FIG. 12(*b*), in this instance, the spacing (s) between facing edges is defined as the length of the portion of the center line ○ at the center of the undulation range (d) intercepted by the facing edges of adjacent orthogonal line elements 32.

Although antennas according to different embodiments of the invention have been explained and discussed above, the antennas of the invention are not specifically limited to these embodiments but can, of course, be appropriately changed or modified without departing from the scope of the invention. For example, although the conductor portion 220 of antenna line pattern of the antenna 1 has a meander shape, this portion may have other shapes, such as a spiral. Further, although the conductor portion 220 is shown as being formed on the outer surface of the dielectric substrate 2, portion 220 may also be formed inside, and outside, the dielectric substrate 2.

What is claimed is:

1. A dielectric antenna for a high frequency wireless communication apparatus, said antenna comprising:

a dielectric substrate;

a conductive meander line layer formed on the dielectric substrate;

a conductive feed line layer formed on the dielectric substrate, said conductive feed line layer being of a greater line width than the meander line layer; and a conductive taper layer connecting the conductive meander line layer to the conductive feed line layer, said conductive taper layer having an edge slanting at an angle $\gamma$ from an adjoining edge of the conductive feed line layer as measured in a direction toward the conductive meander line layer, said conductive taper layer connecting the meander line layer to the conductive feed line layer having a line width which continuously decreases from the line width of the conductive feed line layer toward the conductive meander line layer.

2. A dielectric antenna as claimed in claim 1, wherein said angle $\gamma$ is formed by an edge of the conductive feed line and an edge of the conductive taper layer, and said angle $\gamma$ is an angle of 110°–175°.

3. A dielectric antenna as claimed in claim 1, wherein a slant angle $\alpha$ is formed between an edge of the conductive taper layer and an adjoining edge of the conductive meander line layer, and said angle $\alpha$ is an angle of is 5–70°.

4. A dielectric antenna as claimed in claim 1, wherein the dielectric substrate has a first dielectric constant wherein said antenna further comprises:

a further substrate;

a feed strip formed on a first surface of the further substrate; and a ground plane disposed on a further opposed surface of said further substrate, said conductive feed layer being connected to an extended feed line extending from said feed strip on said first surface of said further dielectric substrate, said further substrate having a dielectric constant lower than said first dielectric constant, and said extended feed line extending by a predetermined length $\beta$ from a position at which the ground electrode terminates and is separated by said further dielectric substrate.

5. A dielectric antenna as claimed in claim 4, wherein said predetermined length $\beta$ is 2.4–7.5 mm.

6. A dielectric antenna as claimed in claim 1, wherein said dielectric substrate constitutes part of a dielectric substrate on which a high frequency circuit module is formed.

7. A dielectric antenna 1 as claimed in claim 1, wherein the width of the meander line layer formed on the dielectric substrate is 0.05–0.3 mm.

8. A dielectric antenna as claimed in claim 1, wherein said conductive feed line layer has a width and includes a portion which extends onto an end surface of the dielectric substrate so as to form a feed terminal thereon through which high frequency electric signals are transmitted or received, said feed terminal having a width equal to the width of the conductive feed line layer.

9. A dielectric antenna as claimed in claim 1, wherein said conductive meander line layer, said conductive feed line layer and said conductive taper layer constitute a common layer.

10. A dielectric antenna as claimed in claim 1, wherein said dielectric substrate has a first dielectric constant and wherein said antenna further comprises:

a further substrate;

a feed strip formed on a first surface of the further substrate; and a ground strip layer formed along the feed strip on the first surface of said further dielectric substrate, said conductive feed layer being connected to an extended feed line extending from said feed strip formed on said first surface of said further dielectric substrate, said extended feed line being extended by a predetermined length of 2.4–7.5 mm from a position at which the ground electrode terminates and is separated by said further dielectric substrate.

11. A dielectric antenna as claimed in claim 1, wherein the meander layer has a longitudinal axis, wherein an edge spacing as measured from an edge of a first meander line element to an adjacent edge of an adjacent meander line element is greater than 0.1 mm and less than two times the width of the meander line elements, and wherein a fold-back width, as measured between the outermost line edges of the meander line layer in a direction normal to the longitudinal axis of the meander line layer, is no greater than 3 mm.

12. A dielectric antenna as claimed in claim 1;

wherein said angle $\gamma$ is an angle of 130°–165°.

13. A dielectric antenna as claimed in claim 1, wherein a slanting angle $\alpha$ formed between an edge of the conductive taper layer and an adjoining edge of the conductive meander line layer is 16°–49°.

14. A dielectric antenna for a high frequency wireless communication apparatus, said antenna comprising:

a dielectric substrate;

a conductive meander line layer formed inside of the dielectric substrate and having a line width;

a conductive feed line layer formed inside of the dielectric substrate, said conductive feed layer having a greater line width than the line width of the meander line layer; and a conductive taper layer formed inside the dielectric substrate and connecting the conductive meander line layer to the conductive feed line layer, an edge of the conductive taper layer slanting at an angle from an edge of the conductive feed line layer in a direction toward the conductive meander line layer, said conductive taper layer connecting the meander line layer to the conductive feed line layer having a line width which continuously decreases from the line width of the conductive feed line layer toward the conductive meander line layer.

15. A dielectric antenna as claimed in claim 14, wherein said dielectric substrate is part of a dielectric substrate on which a high frequency circuit module is formed.

16. A dielectric antenna for high frequency wireless communication apparatus, said antenna comprising:

a first dielectric substrate having a dielectric constant;

a conductive meander line layer formed on the first dielectric substrate and having a line width;

a conductive feed line layer formed on the first dielectric substrate and having a greater line width than the line width of the meander line layer;

a second dielectric substrate having a dielectric constant lower than the dielectric constant of the first dielectric substrate;

a conductive feed strip formed on one surface of the second dielectric substrate;

a ground plane formed on a further, opposite surface of said second dielectric substrate; and an extended feed line extending from said feed strip formed on said one surface of said second dielectric substrate, said extended feed line being extended by a predetermined length β from a position at which said ground electrode terminates and is separated from said second dielectric substrate, said predetermined length β being 2.5–7.5 mm.

* * * * *